US006633013B2

(12) United States Patent
Nishimura et al.

(10) Patent No.: US 6,633,013 B2
(45) Date of Patent: Oct. 14, 2003

(54) LEVER SWITCH

(75) Inventors: Kenji Nishimura, Fukui (JP); Masaki Nakase, Fukui (JP); Yasuchika Kudo, Fukui (JP); Yusho Nakase, Fukui (JP); Yoshiharu Abe, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/279,494

(22) Filed: Oct. 24, 2002

(65) Prior Publication Data

US 2003/0094360 A1 May 22, 2003

(30) Foreign Application Priority Data

Oct. 29, 2001 (JP) ..... 2001-330450

(51) Int. Cl.[7] ..... H01H 21/82
(52) U.S. Cl. ..... 200/559; 200/339
(58) Field of Search ..... 200/559, 400, 200/6 R, 6 B, 6 C, 6 BB, 501, 339, 573, 558, 551

(56) References Cited

U.S. PATENT DOCUMENTS 3,591,747 A * 7/1971 Dennison ..... 200/557
3,678,229 A * 7/1972 Osika ..... 200/43.01
3,689,858 A * 9/1972 Helmut Rosch et al. .... 335/188
4,230,917 A * 10/1980 Osika ..... 200/43.01
6,479,776 B2 * 11/2002 Nakase et al. ..... 200/559
6,525,285 B2 * 2/2003 Kudo et al. ..... 200/559
6,559,401 B2 * 5/2003 Minami et al. ..... 200/559

FOREIGN PATENT DOCUMENTS

EP 471317 * 8/1991

* cited by examiner

*Primary Examiner*—Elvin Enad
*Assistant Examiner*—Lisa Klaus
(74) *Attorney, Agent, or Firm*—RatnerPrestia

(57) ABSTRACT

A lever switch includes a case having a common contact and fixed contacts provided on inner wall opposite to each other. A movable contact made from elastic metal and shaped like the letter "M" has an intermediate section that comes into contact with the common contact. A first arm extends from each one of both ends of the intermediate section. Each one of the ends of the first arms forms a folding-back section, and a second arm is formed at the end of the folding-back section. A contact formed at the end of the second arm comes into contact with the inner wall of the case. Rotation of the lever slides a slider on the bottom plate of the case, and a pushing section provided at each one of both ends of the slider brings the contact into contact with the fixed contact or leaves the contact from the fixed contact.

4 Claims, 6 Drawing Sheets

LEVER SWITCH

FIELD OF THE INVENTION

The present invention relates to lever switches, which are used in various electronic apparatuses, for detecting the presence of a recording medium or the operation of a mechanism.

BACKGROUND OF THE INVENTION

A leaf switch, formed of a combination of a movable contact with fixed contacts, both of the contacts are made of elastic metal thin plate, is well known as a lever switch used for detecting the presence of a recording medium such as a tape or a disc or the operation of various mechanisms.

FIG. 7 through FIG. 9 show a conventional lever switch discussed above. FIG. 7 is a sectional view of the conventional lever switch. Case 31 made from resin is shaped like a box. Case 31 is open in the front thereof and has opening 31A on its upper face. Lever 32 has driving sections 32B and 32C at its lower end and operating section 32D at its upper end. Operating section 32D extends upward from opening 31A.

Movable contact 33 made of elastic metal thin plate and a pair of fixed contacts 34 made of elastic metal thin plate and disposed on both sides of movable contact 33 are rigidly provided respectively on the bottom plate opposite to opening 31A. An upper end of movable contact 33 is inserted between driving sections 32B and 32C. Upper ends of fixed contacts 34 are bowed inside to form contacts 34A facing the intermediate section of movable contact 33. A cover (not shown) covers case 31 that houses movable contact 33 and fixed contacts 34 discussed above. Lever 32 is mounted to case 31 such that lever 32 can rotate on shaft 32A to both sides.

FIG. 8 is a sectional view illustrating a scene where operating section 32D in FIG. 7 is rotated to the right. In this case, since driving section 32C rotates to the left on shaft 32A as a fulcrum, the upper end of movable contact 33 is pushed with driving section 32C and bent leftward. Then the intermediate section of movable contact 33 is brought into contact with contact 34A on the left side.

FIG. 9 is a sectional view illustrating a scene where operating section 32D is further rotated up to a given angle. The upper end of movable contact 33 further moves to the left, and the intermediate section of movable contact 33 pushes contact 34A, so that fixed contact 34 is also bent to the left. As a result, movable contact 33 and fixed contact 34 are kept contacting with each other by a stable contact pressure.

When operating force is removed from operating section 32D, driving section 32C is pushed to the right by the elastic restoring force of movable contact 33 and fixed contact 34. Then lever 32 rotates and operating section 32D is restored to the neutral position as shown in FIG. 7.

When operating section 32D rotates to the left, driving section 32B pushes the upper end of movable contact 33 to the right, so that movable contact 33 is bent to the right and brought into contact with fixed contact 34 on the right side.

In the conventional lever switch discussed above, plate-like movable contact 33 bows to the left or right, so that movable contact 33 is brought into contact with one of fixed contacts 34 on both sides. However, in this mechanism, an appropriate stress to be produced at movable contact 33 requires an adequate length of movable contact 33, so that an entire switch is hard to be downsized.

Further, when lever 32 rotates by the given angle, fixed contact 34 is also bent, whereby the stable contact pressure is obtained between movable contact 33 and fixed contact 34. The contact status thus tends to become unstable when lever 32 rotates halfway.

SUMMARY OF THE INVENTION

A lever switch of the present invention comprises the following elements:

(a) a case including a common contact and fixed contacts;

(b) a movable contact including;

- (b-1) an intermediate section elastically coming into contact with the common contact;
- (b-2) a first arm extending from the intermediate section;
- (b-3) a folding-back section formed at an end of the first arm;
- (b-4) a second arm extending from the folding-back section; and
- (b-5) a contact formed at an end of the second arm and elastically coming into contact with at least one of the inner wall of the case or one of the fixed contacts;

(c) a slider including;

- (c-1) an engaging section; and
- (c-2) a pushing section coming into contact with to a vicinity of the folding-back section; and (d) a lever including:

- (d-1) an operating section;
- (d-2) a shaft which is mounted to the case such that the lever can rotate on the shaft;
- (d-3) an contacting section for contacting with the engaging section.

Rotating of the lever brings the contact into contact with one of the fixed contacts, or leaves the contact from one of the fixed contact.

DETAILED DESCRIPTION OF THE EXEMPLARY EMBODIMENTS

Exemplary Embodiment 1

Figure 1:
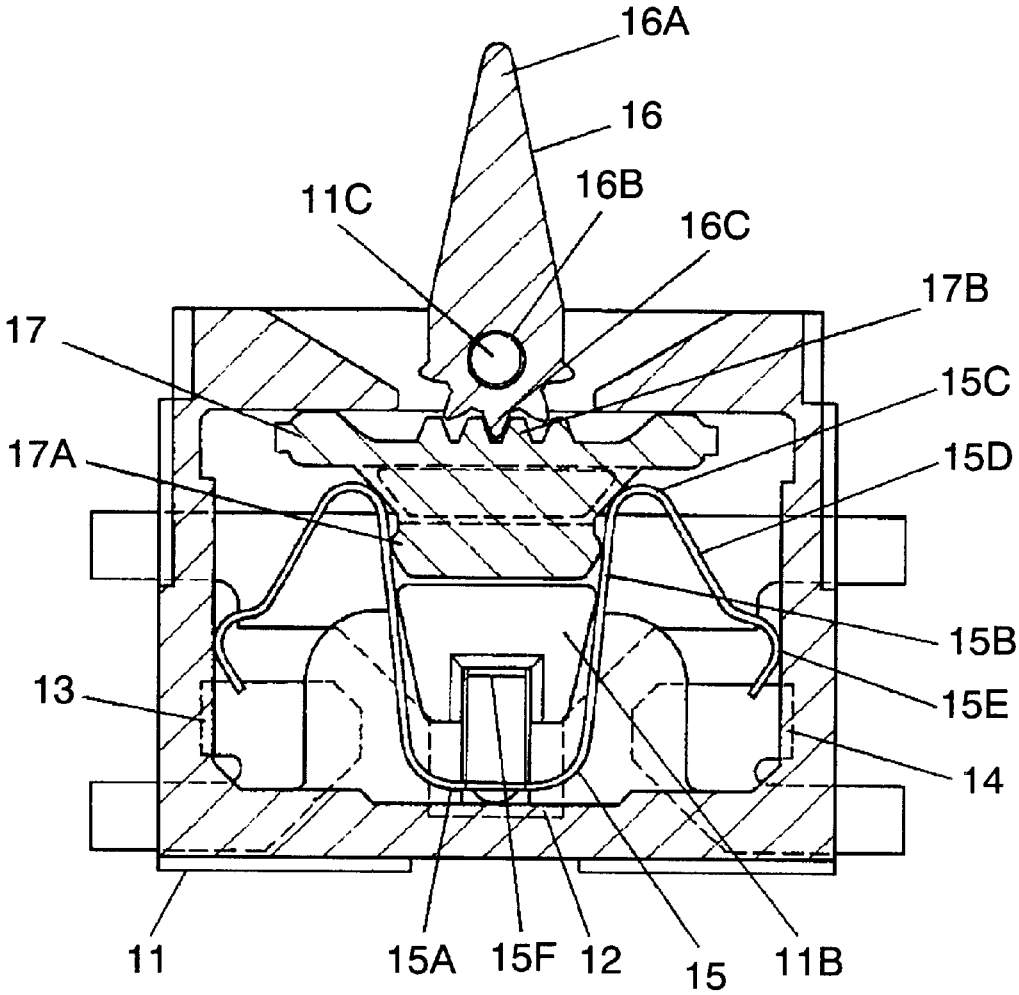
FIG. 1 shows a sectional view of a lever switch in accordance with a first exemplary embodiment of the present invention.
Figure 2:
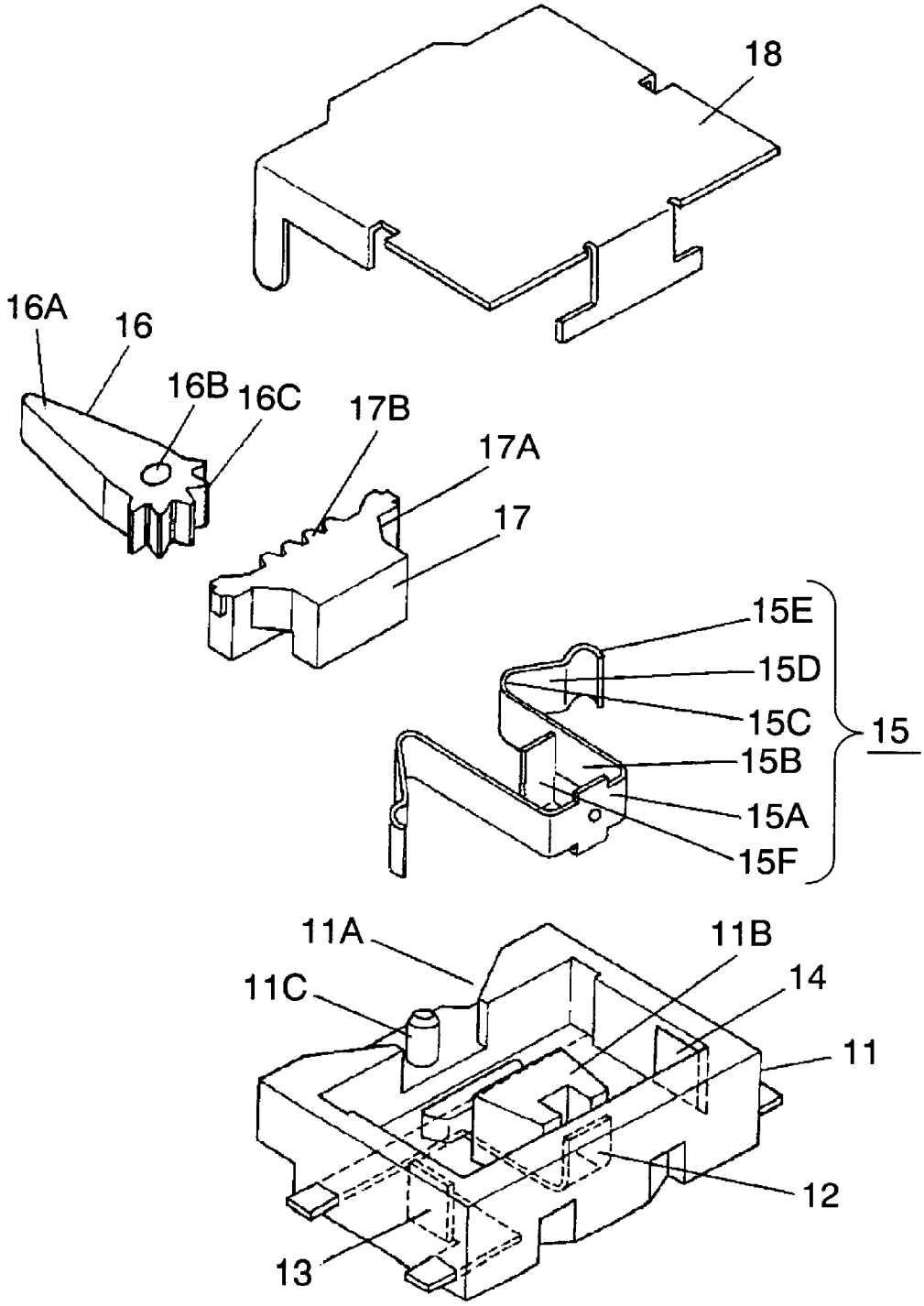
FIG. 2 is an exploded perspective view of the lever switch illustrated in FIG. 1.

FIG. 1 shows a sectional view of a lever switch in accordance with the first exemplary embodiment of the present invention, and FIG. 2 is an exploded perspective view of the lever switch shown in FIG. 1.

In both of the drawings, box-like case 11 made from insulating resin has opening 11A on its upper face. Common contact 12 made from conductive metal is provided at the center of inner wall of the lower side of case 11. A pair of fixed contacts 13 and 14 are adjacent to common contact 12 and opposite to each other. They are formed by insert molding and extend from the inner wall at both the sides of case 11. Movable contact 15 is formed of elastic metal thin plate made from phosphorous bronze or beryllium bronze, and shaped like the letter "M". An arc-shaped protrusion disposed beneath the lower face of intermediate section 15A of movable contact 15 is urged to common contact 12. First arms 15B extend to both sides from both the ends of intermediate section 15A. First arms 15B are brought into contact with holder 11B protruded to the center of case 11, then extend outward. Each one of the ends of first arm 15B forms folding-back sections 15C and second arms 15D extend from these folding-back sections 15C. Each one of the ends of second arms 15D bows outward, and contacts 15E urge against the inner wall of both sides of case 11.

Elastic section 15F shaped like the letter "L" is disposed on intermediate section 15A and extends upward. Elastic section 15F is bowed and its end urges against the lower face of holder 11B disposed at the center of case 11, so that the protrusion beneath the lower face of intermediate section 15A is brought into elastic contact with common contact 12 by a stable contact pressure.

Operating section 16A, located at an upper end of lever 16 made of insulating resin, extends upward from opening 11A. Circular shaft receptacle 16B provided at lever 16 is mounted rotatably on cylindrical shaft 11C disposed in case 11. Contacting section 16C shaped like a gear is provided at the lower end of lever 16.

Slider 17 made from insulating resin is slidable to the right and left and housed in case 11. Pushing sections 17A provided at both the ends of slider 17 are brought into contact with a vicinity of folding-back section 15C. Teeth-like engaging section 17B provided on the upper face of slider 17 engages with contacting section 16C formed at the lower end of lever 16. Cover 18 covers case 11 that accommodates movable contact 15, lever 16, slider 17 and others, so that the lever switch is constructed.

Figure 3:
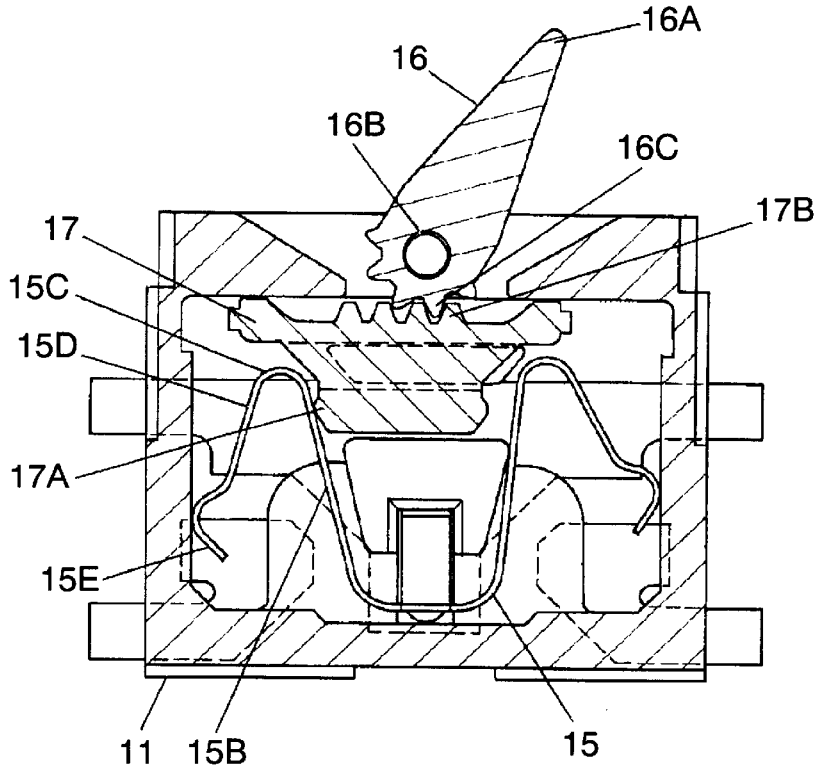
FIG. 3 shows a sectional view of the lever switch, shown in FIG. 1, rotating halfway.

FIG. 1 shows a neutral status, i.e., lever 16 stands up straight. FIG. 3 is a sectional view illustrating the status where operating section 16A is rotated halfway to the right. In FIG. 3, engaging section 17B engages with contacting section 16C, and lever 16 rotates on shaft 11C as a fulcrum. Slider 17 thus slides to the left on the bottom plate of case 11.

Then pushing section 17A at the left end of slider 17 pushes first arm 15B. As a result, first arm 15B and second arm 15D on the left side are bowed, and left contact 15E elastically slides downward on the left inner wall of case 11.

Figure 4:
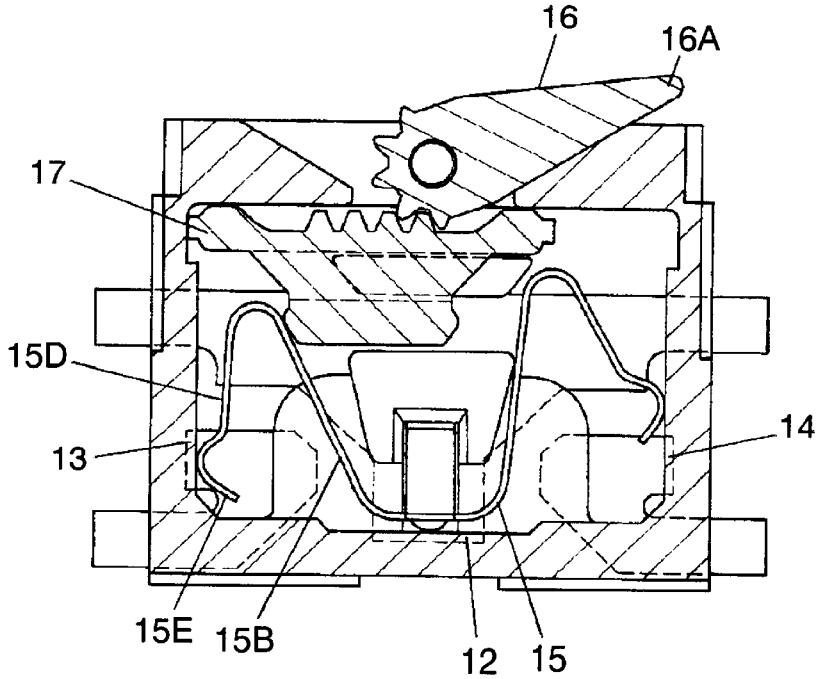
FIG. 4 shows a sectional view of the lever switch, shown in FIG. 1, completing rotation.

FIG. 4 is a sectional view of a scene where operating section 16A shown in FIG. 3 is further rotated. In FIG. 4, contact 15E further slides downward and is brought into contact with fixed contact 13, whereby fixed contact 13 is electrically coupled to common contact 12 via movable contact 15.

When operating force applied to operating section 16A is removed, contact 15E elastically slides upward and leaves fixed contact 13 due to elastic restoring force of bowed movable contact 15. At the same time, slider 17 pushed by movable contact 15 slides toward the center, so that lever 16 rotates and operating section 16A restores to the neutral status as shown in FIG. 1.

When operating section 16A is rotated to the left, slider 17 slides to the right, and contact 15E on the right-hand side elastically slides downward, which brings contact 15E into contact with fixed contact 14. As a result, common contact 12 is electrically coupled to fixed contact 14 via movable contact 15.

As this first embodiment describes, movable contact 15 is shaped like the letter "M" formed of intermediate section 15A, first arm 15B, folding-back section 15C and second arm 15D. Whole movable contact 15 is bent, and intermediate section 15A is kept urging against common contact 12. In this condition, one of contacts 15E at both the ends urges against fixed contact 13 or 14. As a result, movable contact 15 can increase the contact pressure applied to fixed contact 13 or 14 by an appropriate stress. In addition to this advantage, the whole switch can be downsized. Since contact 15E elastically slides on the inner wall of case 11 to contact with or leave fixed contact 13 or 14, even if lever 16 rotates still halfway, a stable contact pressure can be secured at contact 15E. Thus a lever switch keeping a stable contact can be obtained.

Structural elements such as moving contact 15, lever 16, slider 17 and the like are piled up one after another on the bottom plate of case 11, thereby assembling the lever switch. Thus this structure allows manufacturing lever switches with ease and at a low cost.

Holder 11B brought into contact with first arm 15B is provided at the center of case 11, so that movable contact 15 can be firmly held with holder 11B. As a result, movable contact 15 can be prevented from deforming during the assembly work. During the assembly work, movable contact 15 is bowed to a given place with holder 11B, and lever 16 as well as slider 17 can be assembled in this condition, so that respective elements can be assembled into case 11 with ease.

Further, elastic section 15F, extending upward, is provided to intermediate section 15A of movable contact 15. This elastic section 15F gives predetermined force to the protrusion beneath the lower face of intermediate section 15A, so that movable contact 15 can be brought into contact with common contact 12 by a stable contact pressure.

Exemplary Embodiment 2

Figure 5:
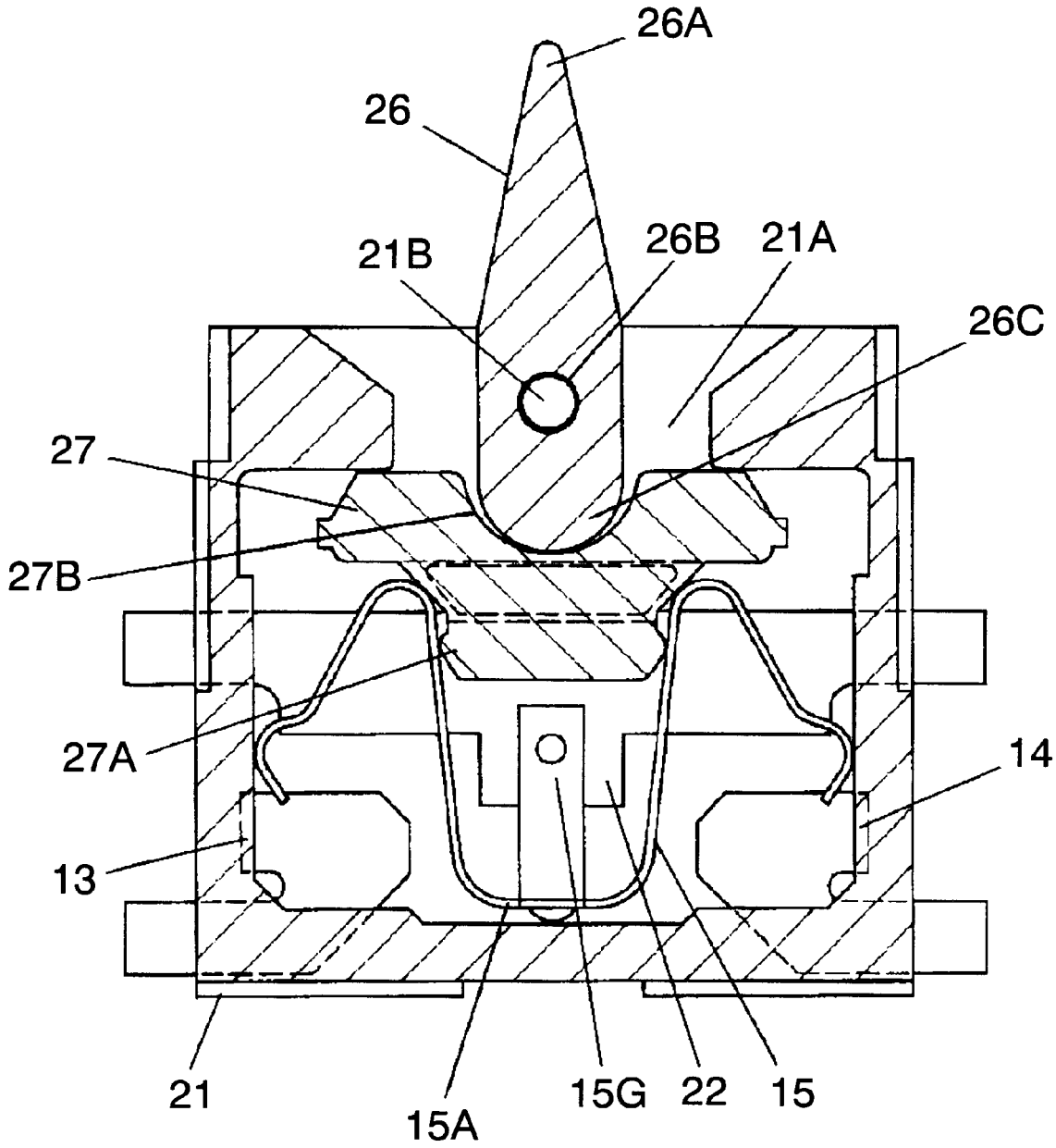
FIG. 5 shows a sectional view of a lever switch in accordance with a second exemplary embodiment of the present invention.

FIG. 5 is a sectional view of a lever switch in accordance with the second exemplary embodiment. Similar elements to those used in the first embodiment have the same reference marks, and the detailed descriptions thereof are omitted here.

In FIG. 5, common contact 22 made from conductive metal is rigidly provided by insert molding to the center of inner bottom plate of case 21 which is shaped like a box and made from insulating resin. A pair of fixed contacts 13 and 14 are rigidly provided by insert molding to inner wall on both sides. Movable contact 15 shaped like the letter "M" is housed in case 21. The foregoing structure is the same as that of the first embodiment.

Operating section 26A provided at an upper end of lever 26 extends upward from opening 21A of case 21, and circular shaft receptacle 26B provided an intermediate place of lever 26 is rotatably mounted on shaft 21B provided on case 21. This structure is also the same as that of the first embodiment.

Contacting section 26C is provided at the lower end of lever 26. Slider 27 can slide to either side and is housed in case 21. On the upper face of slider 27, recessed engaging section 27B is provided, and contacting section 26C is inserted to engaging section 27B. Further, tongue-like slip 15G extends upward from the center of intermediate section 15A of movable contact 15, and a tip of tongue-like slip 15G urges to common contact 22.

Figure 6:
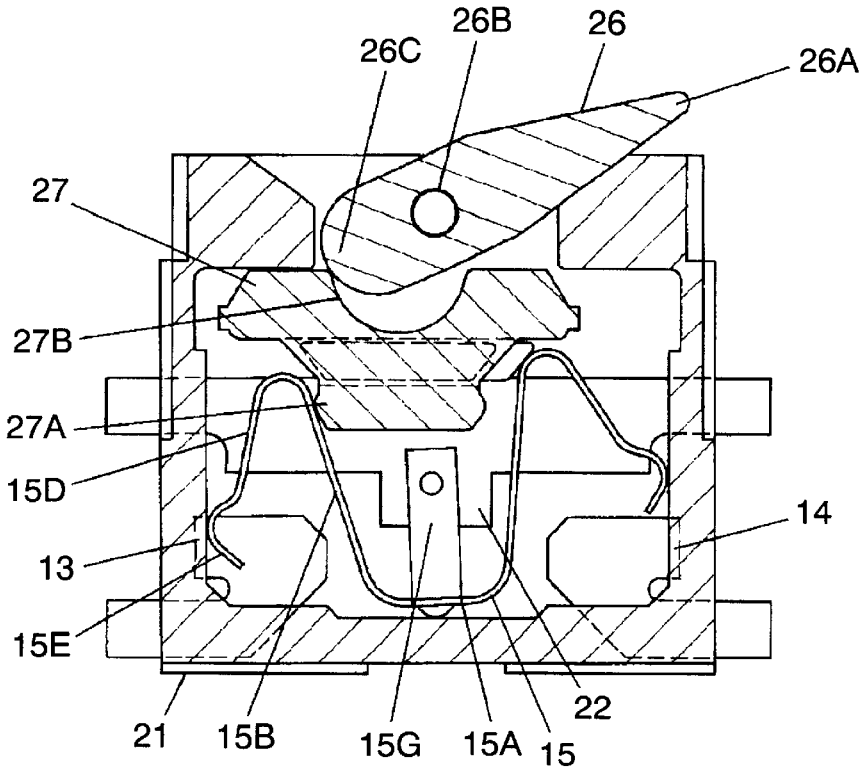
FIG. 6 shows a sectional view of the lever switch, shown in FIG. 5, completing rotation.
Figure 7:
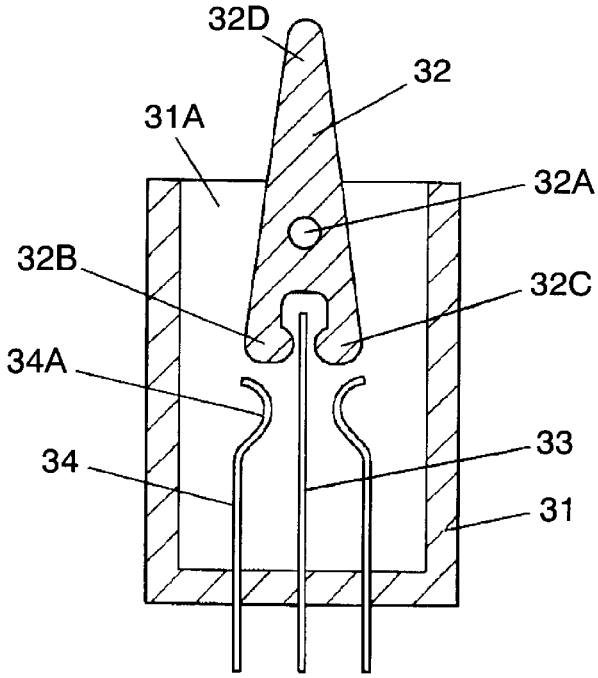
FIG. 7 PRIOR ART
FIG. 7 shows a sectional view of a conventional lever switch.
Figure 8:
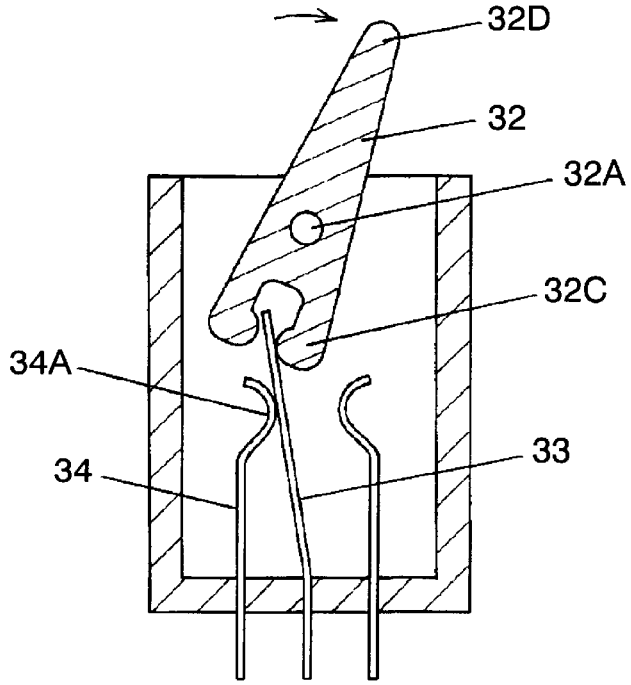
FIG. 8 PRIOR ART
FIG. 8 shows a sectional view of the lever switch, shown in FIG. 7, rotating halfway.
Figure 9:
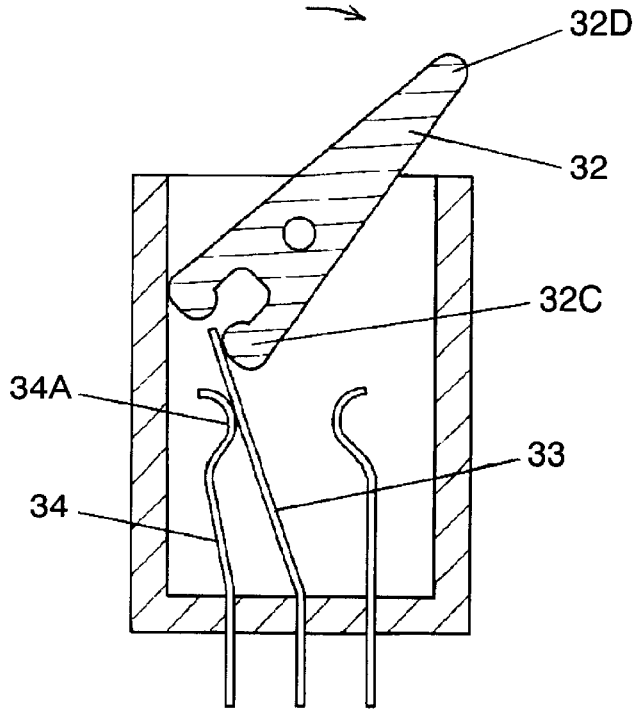
FIG. 9 PRIOR ART
FIG. 9 shows a sectional view of the lever switch, shown in FIG. 7, completing rotation.

FIG. 6 is a sectional view illustrating a scene where operating section 26A is rotated to the right from the neutral status shown in FIG. 5. In FIG. 6, lever 26 rotates on shaft 21B as a fulcrum, and slider 27 slides to the left on the inner bottom plate of case 21 because contacting section 26C is inserted in engaging section 27B.

Pushing section 27A at the left end of slider 27 pushes first arm 15B of movable contact 15, so that first arm 15B and second arm 15D on the left side are bent, and left contact 15E slides downward on the inner wall on the left side of case 21. As a result, contact 15E is brought into contact with fixed contact 13, and fixed contact 13 is electrically coupled to common contact 22 via movable contact 15.

The foregoing movement of movable contact 15 is followed by tongue-like slip 15G such that the upper edge of slip 15G slides to the left on common contact 22.

When operating force applied to lever 26 is removed, lever 26 restores to the neutral status as shown in FIG. 5 due to elastic restoring force of movable contact 15. This is similar to the phenomenon discussed in the first embodiment. When operating section 26A is rotated to the left, slider 27 slides to the right, so that fixed contact 14 is electrically coupled to common contact 22 via movable contact 15. This is also similar to the phenomenon described in the first embodiment.

The second embodiment produces the following advantage besides the advantages by the first embodiment: In the second embodiment, contacting section 26C, shaped like a semicircle and formed at the lower end of lever 26, is inserted into recessed engaging section 27B. On the other hand, in the first embodiment, contacting section 16C shaped like a gear and formed at the lower end of lever 16 is engaged with teeth-like engaging section 17B formed on the upper face of slider 17. Thus lever 26 and slider 27 used in the second embodiment can be worked easier than the counterparts used in the first embodiment. The switch can be also manufactured easier, and assembly of the switch can be automated with ease.

In the second embodiment, tongue-like slip 15G extending upward is provided at the center of intermediate section 15A of movable contact 15, and the end of slip 15G urges to common contact 22. Movement of movable contact 15 slides the end of slip 15G on common contact 22, thereby removing foreign substances such as dust and carbide from the surface of common contact 22. As a result, stable contact can be expected.

The foregoing description shows the switch structure where the rotation of lever 16 or 26 brings one of contacts 15E at both the ends of movable contact 15 into contact with one of fixed contacts 13 or 14. In other words, the description refers to a switch of normal-off. However, the present invention is also applicable to the following structure: When lever 16 or 26 is in the neutral status, one of contacts 15E is brought into contact with one of fixed contacts 13 or 14, and when lever 16 or 26 rotates, contact 15E leaves fixed contact 13 or 14. The present invention namely can be implemented to the lever switch of normal-on.

In the foregoing description, movable contact 15 made from elastic metal thin plate is used, which is easy to be manufactured by press-work using a metal-die, however, it can be formed by forming round metal-wire made from e.g., copper alloy.

The present invention thus can provide a lever switch easy to be downsized and manufactured keeping stable contact. The present invention also overcomes the problems in the prior art.

What is claimed is:

1. A lever switch comprising:

(a) a case, whose upper face has an opening, having a common contact and fixed contacts that are provided on inner wall of the case opposite to each other;

(b) a movable contact shaped like a letter "M" made from elastic metal plate and including:

(b-1) an intermediate section coming into contact with the common contact;

(b-2) a first arm extending from both ends of the intermediate section;

(b-3) a folding-back section formed at an end of the first arm;

(b-4) a second arm extending from the folding-back section;

(b-5) a contact formed at an end of the second arm and coming into contact with at least one of the inner wall of the case and one of the fixed contacts;

(c) a slider including:

(c-1) an engaging section formed on upper face of the slider;

(c-2) a pushing section brought into contact with a vicinity of the folding-back section; and (d) a lever including:

(d-1) an operating section extending upward from the opening of the case;

(d-2) a shaft receptacle for being rotatably mounted to the case;

(d-3) a contacting section formed at an lower end of the lever and brought into contact with the engaging section, wherein a rotation of the lever slides the slider on inner bottom plate of the case, so that the contact and the fixed contact are brought into contact with each other or separated from each other.

2. The lever switch of claim 1 further comprising a holder located at a center of the inner bottom plate of the case and brought into contact with the first arm.

3. The lever switch of claim 1, wherein the movable contact further includes an elastic section extending from the intermediate section and bringing the intermediate section into contact with the common contact.

4. The lever switch of claim 1, wherein the movable contact further includes a slip extending from the intermediate section and an end of the slip comes into contact with the common contact.

* * * * *